United States Patent [19]

Morrison

[11] Patent Number: 4,478,179

[45] Date of Patent: Oct. 23, 1984

[54] RADIAL PISTON ENGINES

[75] Inventor: Ronald D. Morrison, Edmonton, Canada

[73] Assignee: Morrison Motor Corporation, Edmonton, Canada

[21] Appl. No.: 558,831

[22] Filed: Dec. 7, 1983

[51] Int. Cl.[3] ..... F02R 57/08

[52] U.S. Cl. ..... 123/44 B; 123/44 C

[58] Field of Search ..... 123/43 R, 44 R, 44 B, 123/43 C

[56] References Cited

U.S. PATENT DOCUMENTS

| | | | |
|---|---|---|---|
| 1,037,400 | 9/1912 | Youngren | 123/44 B |
| 1,068,297 | 7/1913 | Baird et al. | 123/44 B |
| 1,716,711 | 6/1929 | Southern | 123/43 R |
| 3,292,603 | 12/1966 | Wayto | 123/44 D |

FOREIGN PATENT DOCUMENTS

| | | | |
|---|---|---|---|
| 464422 | 3/1914 | France | 123/43 R |
| 9525 | 4/1913 | United Kingdom | 123/44 B |

*Primary Examiner*—Ira S. Lazarus
*Assistant Examiner*—R. S. Bailey
*Attorney, Agent, or Firm*—Sim & McBurney

[57] ABSTRACT

An internal combustion engine combines the efficiency of a radial engine with the practicality of a piston and crankshaft arrangement. A stationary frame supports a stationary sun gear, and a rotor is pivoted about the axis of the sun gear. The rotor carries three crankshafts at 120° intervals, each having an eccentric portion. Each crankshaft is fixed to rotate with a respective planetary gear, and all the planetary gears mesh with the sun gear and have the same pitch diameter as the sun gear. The crankshaft eccentricity is substantially ⅓ times the pitch radius of a planetary gear. The eccentric portion of each crankshaft has roller means rotatable about the same axis as the connection between the connecting rod and the eccentric portion, and a ring member with an internal surface surrounds and contacts all of the roller means simultaneously, the ring member being free to rotate about its own axis. Three valves admit the combustible mixture to each cylinder. A valve shaft reciprocates in a bore of the rotor, the bore being substantially radially arranged with respect to the rotor axis. The shaft has at its end remote from the valve head a roller adapted to contact the internal surface of the ring member over a fraction of each rotor revolution, thereby to depress the valve for the admission of the combustible mixture. Porting means are provided for exhausting products of combustion from each cylinder.

9 Claims, 2 Drawing Figures

RADIAL PISTON ENGINES

This invention relates generally to internal combustion engines, and pertains particularly to an engine which combines the best advantages of a radial engine structure with a cylinder and piston means.

BACKGROUND OF THIS INVENTION

In conventional reciprocating engines, the straight-line movement of pistons and parts is conveyed to the rotational movement of the crankshaft, which tends to produce energy loss due to poor rotational dynamics, and to sudden mass accelerations in the pistons and related parts. Because of the "stop-start" nature of the piston and connecting link action, considerable energy loss, wear and frictional forces are encountered, which tend to draw energy away into non-useful heat and to produce wear and degradation which, if eliminated, would lengthen the left of engine parts and improve efficiency.

Many radial engine designs have been devised in the past. However, most such designs do away with the piston/cylinder concept altogether, and replace the combustion chamber with various forms of dynamic chambers defined between sliding or rotating members, the geometry being such as to increase and decrease the size of the combustion chamber. Such conventional radial engines have all encountered a number of problems in their development, with the result that few if any radial engine designs are commercially used in the automobile market at the present time in North America.

My co-pending U.S. Patent Application Ser. No. 376,695, filed May 10,, 1982 and entitled "Improvements in Internal Combustion Engines" provides an advantageous and novel structure which combines the radial engine concept with the practicality of a piston. More specifically, the invention described in my co-pending application is one which allows rotational movement to enhance the intake of the combustible mixture and the exhaust of combustion gases, to move lubricating oil in a preferential direction, and to facilitate valve movement. In the device described in my co-pending application, the design is such that the piston when under pressure moves away from centre.

More particularly, the invention described in my co-pending application provides a rotary frame carrying three cylinder/piston combinations spaced at 120° intervals, the machine dynamics being arranged in such a way that the pistons, while indeed reciprocating with respect to their individual cylinders, nonetheless when viewed from a stationary frame of reference are seen to move in a substantially circular path, thus reducing acceleration forces on the piston to a minimum, and contributing to an extremely smooth operation. Furthermore, the pistons are arranged so that they fire out from center (with the centrifugal force). Moreover, the connecting rods undergo primarily a circular movement, although with a superimposed wobble. Finally, the eccentric portion of each crankshaft also travels in a substantially circular motion.

While the engine described in my co-pending application functions quite satisfactorily, there are certain limitations on its maximum speed due to the use of belts or chains for the valve timing sequence. Centrifugal forces in these elements place an upper limit on the speed at which the engine can rotate.

GENERAL DESCRIPTION OF THIS INVENTION

I have now devised a modified and improved form of the engine, which does away with belts or chains for timing, and which moreover provides special elements for absorbing centrifugal loads, thereby relieving other more sensitive portions of the apparatus of the necessity to transmit or absorb those centrifugal loads.

More particularly, the present invention provides a combination of a stationary frame means, a stationary sun gear on the frame means, and a rotor pivoted about the axis of the sun gear. The rotor carries three crankshafts at substantially 120° intervals, each having an eccentric portion, and for each crankshaft there is a cylinder in the rotary frame with a piston mounted for reciprocation in each cylinder. A connecting rod extends from each piston to the eccentric portion of the corresponding crankshaft. Each crankshaft is fixed to rotate with a respective planetary gear, and all planetary gears mesh with the sun gear and have the same pitch diameter as the sun gear. This means that any point on the pitch circle of a planetary gear describes a cardioid as the planetary gear rotates around the sun gear once. The crankshaft eccentricity is substantially $\frac{1}{3}$ of the pitch radius of a planetary gear. The eccentric portion of each crankshaft has roller means rotatable about the same axis as the connection between the connecting rod and the eccentric portion. A ring member has an internal surface surrounding and contacting all of the roller means simultaneously, the ring member being free to rotate about its own axis. The combination further includes fuel metering means for providing a combustible mixture for the cylinders, and ignition means to ignite the combustible mixture in each cylinder. Three valves are provided for admitting the combustible mixture to the cylinders, each valve having a valve shaft and a valve head at one end of the shaft, the shaft reciprocating in a bore of the rotor, the bore being substantially radially arranged with respect to the rotor axis. The valve shaft has at its end remote from the valve head a roller adapted to contact the internal surface of the ring member over a fraction of each rotor revolution, thereby to depress the valve for the admission of the combustible mixture. Porting means are provided for exhausting products of combustion from each cylinder.

GENERAL DESCRIPTION OF THE DRAWINGS

One embodiment of this invention is illustrated in the accompanying drawings, in which FIGS. 1*a* and 1*b* are two halves of an axial sectional view of an internal combustion engine constructed in accordance with this invention.

DETAILED DESCRIPTION OF THE DRAWING

Figure 1A:
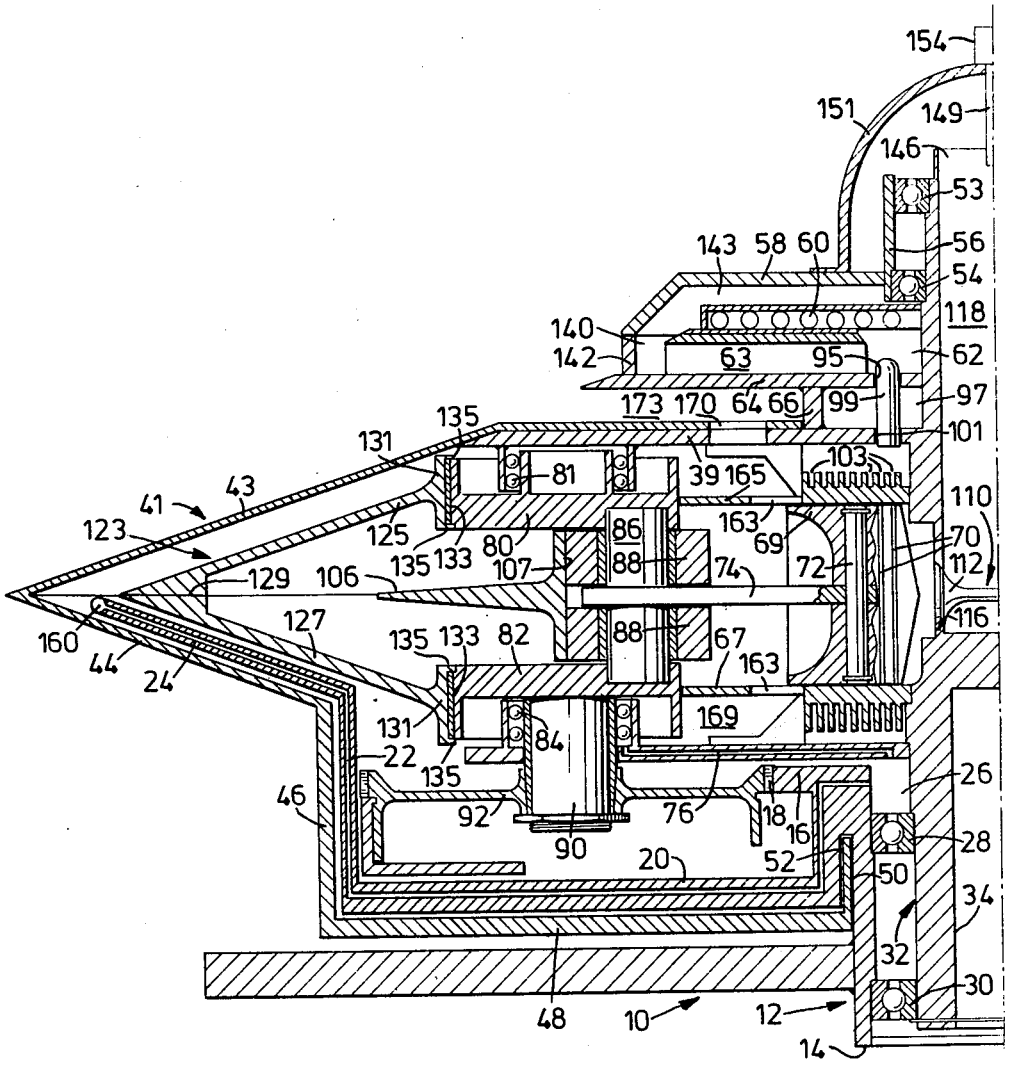
Figure 1B:
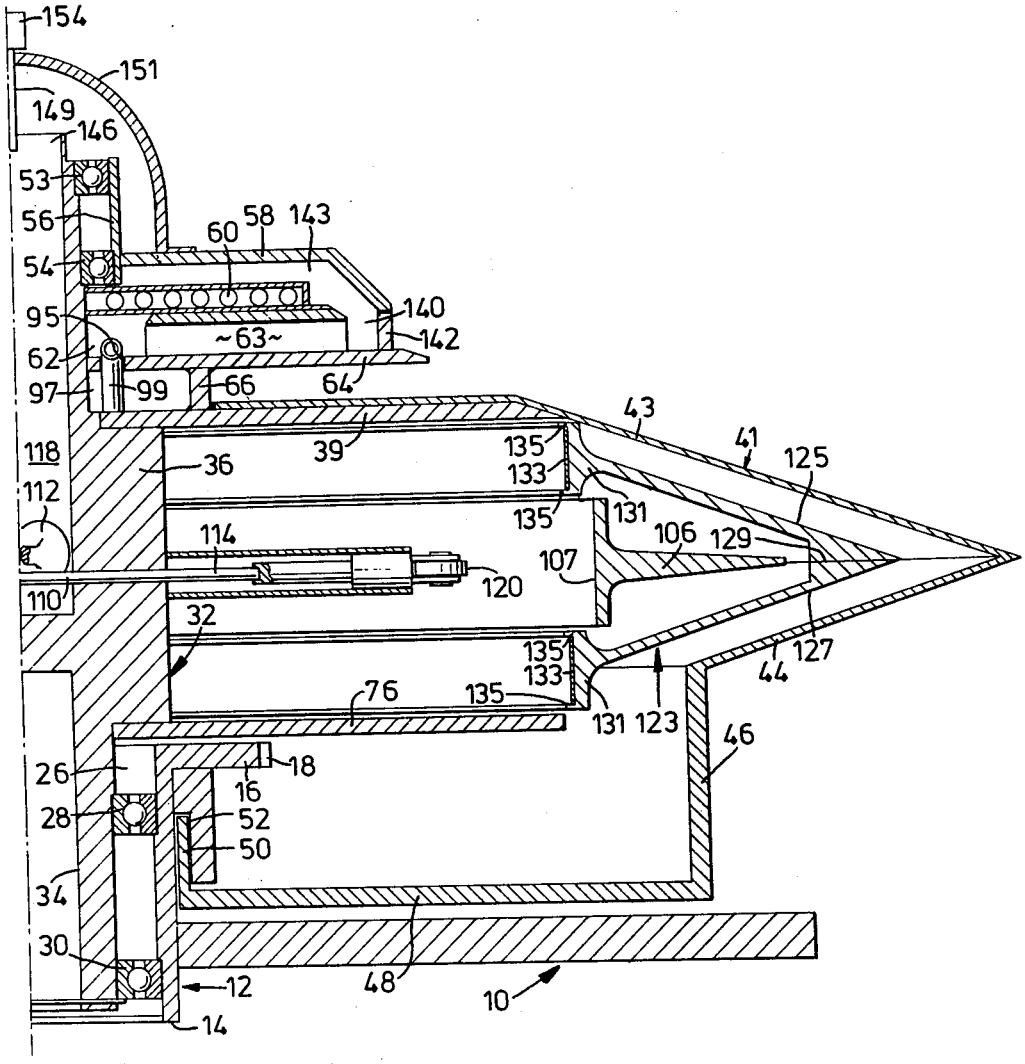

In the drawing, the numeral 10 designates a stationary motor mount which is intended to allow the motor to be mounted to the chassis of an automobile or other vehicle. Welded to the motor mount 10 is a stationary sleeve 12 having a lower end 14 projecting through the bottom side of the motor mount 10, and having at its upper end an annular flange 16 defining at its outer periphery a sun gear 18.

Fixedly connected to the sleeve 12 is a radially extending plate 20 which joins an axially extending portion 22, which in turn joins an obliquely extending portion 24. The plate 20 and the portions 22 and 24 contain a passage for oil, and allow oil to be returned from the remote end of the portion 24 to the space 26 within the internal surface of the sleeve 12, by a means which will be explained subsequently. The oil returned to the space 26 is available to lubricate two bearings 28 and 30 which are mounted within the sleeve 12 and which mount for rotation the lower end of a rotor 32. The rotor 32 has an internal bore 34 extending axially upwardly from its lower end, in order to reduce its weight. The rotor 32 includes a central thicker portion 36 in which the piston cylinders are provided (as will be hereinafter described). At the upper end of the thicker portion 36, there is secured to the rotor 32, for example by welding, an annular plate 39 which rotates with the rotor. The annular plate 39 supports an outer V-shaped housing member 41, and is secured thereto so that the housing member 41 is a rotating member. More particularly, the housing member 41 includes a first frusto-conical plate 43 which is connected at its outer rim to a second frusto-conical plate 44, the latter being connected at its inner rim to a cylindrical member 46 extending axially downwardly and being connected at its lower edge to an annular plate 48. The annular plate 48 has, at its inner periphery, an upwardly extending sleeve 50, which is received within an appropriate slot 52 in the sleeve 12 without physical contact therewith. It will thus be seen that the rotor 32, the plate 39, the housing member 41, the cylindrical member 46, the plate 48 and the sleeve 50 all rotate together as a unit with respect to the sleeve 12 and the sun gear 18.

At its upper end, the rotor 32 rotates in bearings 53 and 54 which are held in a stationary sleeve 56 fixed in turn to a stationary annular plate 58. It is to be understood that the annular plate 58 is mounted, by means not shown, securely to the chassis of the vehicle.

The numeral 60 represents an air intake manifold which gathers air in from opposite sides of the engine, when seen looking in an axial direction, and delivers the air to an air plenum 62. From the plenum 62, air is urged centrifugally outwardly by a plurality of substantially radially aligned blades 63 which are secured to a rotating plate 64 fixed at its inner end to the rotor 32 and braced by means of a sleeve member 66 with respect to the plate 39. The sleeve member 66 is welded both to the plate 64 and the plate 39.

The thicker portion 36 of the rotor 32 is shaped to define three cylinders at intervals of 120°, one of the cylinders being shown at 67 to the left in the figure. Mounted for reciprocation in each cylinder 67 is a piston 69 which is provided with conventional piston rings 70. The piston 69 has a wrist pin 72 in the usual way, to which a conventional connecting rod 74 is pivoted.

Secured to the rotor 32 at the bottom end of the thicker portion 36 is a further annular plate 76 which, along with plate 39, supports for rotation three crankshafts which are at intervals of 120°.

Looking to the left in the figure, each crankshaft includes a first drum member 80 rotatably mounted to the plate 39 by virtue of bearings 81, and a second drum member 82 rotatably mounted with respect to the plate 76 by virtue of bearings 84. The two drum members 80 and 82 support an eccentric shaft 86 to which the other end of the connecting rod 74 is connected in the usual way. However, it can be seen in the figure that the connecting rod 74 is attached only to the middle portion of the shaft 86. As can be seen, two rollers 88 are also rotatably mounted on the shaft 86, one above and one below the connecting rod 74. The rollers 88 will not undergo any substantial rotation, as will hereinafter appear, and therefore they can be mounted on relatively inexpensive bearings, or simply mounted for a direct slip fit around the shaft 86.

The drum member 82 has an elongated central shaft 90 projecting through the plate 76, and having mounted thereto a planetary gear 92 which meshes with the sun gear 18. The pitch diameter of the planetary gear 92 is the same as the pitch diameter of the sun gear 18, whereby any point on the pitch circle of one of the planetary gears describes a cardioid as the planetary gear rotates around the sun gear once.

Turning briefly to the cooling of the cylinder 67, it will be seen that passages 95 are provided between the plenum 62 and the space 97 within the sleeve 66 are between the plates 39 and 64. Extending into the space 97 are a plurality of directional scoops 99 which communicate through bores 101 in plate 39 with a plurality of air grooves 103 that surround the cylinder 67 for cooling the same.

A ring member 106 is provided, and has an internal surface 107 that surrounds and contacts all of the rollers 88 (for all three of the crankshafts) simultaneously, the ring member being free to rotate about its own axis, and in fact being free of contact with any part of the engine except for the rollers 88. The purpose of the ring member 106 is to absorb the centrifugal load exerted by the piston 69 and the connecting rod 74.

By ensuring that the crankshaft eccentricity, i.e. the distance between the centre of the shaft 86 and the centre of the shaft 90, is $\frac{1}{3}$ times the pitch radius of the planetary gear 92, the locus described by the shaft 86 when seen from a stationary frame of reference is substantially circular. This means that the ring member 106 will always remain substantially in the off-centre position shown in the figure, and will rotate with the rotor 32 at the same speed as the rotor. Because the crankshafts are rotating about their axes with respect to the rotor, the rollers 88 will simply rock back and forth, but will not rotate or spin at high speeds.

By ensuring the presence of an oil film between the surface 107 and the rollers 88, a highly efficient means of absorbing centrifugal loads is provided, without generating any significant heat at the contacting surfaces through friction.

Having now explained that the ring member 106 remains always off centre with respect to the rotor 32, it is appropriate to explain how the valves function which admit a combustible mixture of gases to the cylinders. Looking at the figure, a valve is shown at 110, having a valve head 112 and a valve shaft 114. The valve head 112 engages a valve seat 116, such that when the valve is depressed (moves to the left in the drawing) there is communication between the cylinder 67 and a central bore 118 in the rotor 32. The combustible mixture of gases is present in the bore 118, by means which will be explained subsequently.

As can be seen, the shaft 114 of the valve 110 extends substantially radially with respect to the rotor 32, and has at its end remote from the valve head 112 a roller 120 which is adapted to contact the internal surface 107 of the ring member 106 over a fraction of each rotor revolution, thereby to depress the valve for the admission of the combustible mixture from the bore 118 into the respective cylinder 67. In the figure, the valve 110 is shown at its position 180° rotated from the position in which it is depressed and would admit combustible gases to its respective cylinder. The valve 110 is biased to the closed position due to centtrifugal force.

The engine further includes a second ring member 123 which is preferably comprised of two frusto-conical portions 125 and 127, secured together at a joint plane 129, as by welding. At the inner end of each frusto-conical portion 125 and 127 is an enlarged part 131 defining an internal cylindrical surface 133 bordered by inwardly directed ribs 135. The internal cylindrical surfaces 133 engage the outer cylindrical surfaces of all of the drums 80, 82 of the three crankshaft arrangements, as particularly seen at the left in the figure. The second ring member 123 is freely floating within the rotating housing member 41. Because the drums 80 and 82 rotate as the associated planetary gears revolve around the stationary sun gear 18, their outer surfaces move linearly at a faster rate than the rotation of the rotor 32. This in turn will cause the second ring member 123 to rotate at a faster rate than the rotor 32.

The function of the second ring member is to absorb centrifugal loads from the drums 80, 82, which otherwise would have to be taken at the mounting locations for the drums, thus putting excessive loading on the bearings which support the drums.

Returning to the upper portion of the apparatus shown in the figure, it has been explained that the blades 63 rotate with the rotor 32, and cause air reaching the planum 62 to be centrifugally flung outwardly. The air passing off the outer perimeter of the blades 63 reaches a space 140 defined between a rotating cylindrical sleeve 142 and the stationary plate 58. The air in this space is pressurized with respect to atmospheric, and communicates along a passageway 143 with the upper end 146 of the bore 118.

A tube 149 projecting through the upper part 151 of the stationary plate 58 is connected to a component 154 which is intended to schematically represent a conventional means for supplying under pressure a combustible gas, fluid or atomized liquid through the tube 149 and into the bore 118 of the rotor 32. Within the bore 118, the combustible material mixes with the combustion air passing along the passageway 143 and within the portion 151 of the stationary housing 58, to provide a combustible mixture available at the valve head 112.

Attention is now directed again to the plate 20 and the portions 22 and 24, within which an oil passage is provided, the oil passage communicating with the space 26 around the lower end of the rotor 32. At the outer or remote end of the portion 24 there is provided an oil scoop opening 160, which is spaced from but adjacent the apex of the V-shaped rotating housing member 41. Because of centrifugal force, lubricating oil in the various rotating portions of this engine will tend to collect in the apex of the housing member 41. Because the latter is rotating past a stationary oil scoop opening 160, the opening 160, which opens in the upstream direction with respect to oil movement, will be able to scoop the oil and transmit it along the internal passageway back to the space 26 from where it is available to lubricate the bearings 28 and 30. Appropriate oil passageways may also be provided in the plate 76 to bring oil to the location of the bearing 84.

The engine described herein is intended to operate as a two-stroke, two-cycle engine, in which burned gases are scavenged out of the cylinder by virtue of their pressure and by the pressure of the in-coming unburned combustible mixture as the valve 110 opens. The opening of the valve 110 takes place when the piston 70 is near the bottom of its stroke, i.e. furthest from the axis of the rotor 32. As the piston moves away from the axis of the rotor 32, its inner rim will clear a plurality of ports 163 in the side wall of the sleeve 165 defining the cylinder 67. The ports communicate with an annular chamber 169 surrounding the sleeve 165, and the chamber 169 communicates through one or more radial openings 170 to the space 173 between the plate 39 and the plate 64. This space is open to the atmosphere, thus allowing the burned products of combustion to escape from the engine.

It is to be understood that this engine construction may be utilized either with spark firing or diesel firing. For simplicity, neither a spark plug nor a glow-plug has been illustrated, however conventional technology is available to power either of these ignition means within the cylinders, even though the cylinders are defined in a rotating member (the rotor 32).

While one embodiment of this invention has been illustrated in the accompanying drawing and described hereinabove, it will be evident to those skilled in the art that changes and modifications may be made therein without departing from the essence of this invention, as set forth in the appended claims.

I claim:

1. In combination:

stationary frame means, a stationary sun gear on the frame means, a rotor pivoted about the axis of the sun gear, the rotor carrying three crankshafts at substantially 120° intervals, each having an eccentric portion, for each crankshaft a cylinder in the rotor, a piston mounted for reciprocation in each cylinder, and a connecting rod from the piston to the eccentric portion of the crankshaft, each crankshaft being fixed to rotate with a respective planetary gear, all planetary gears meshing with the sun gear and having the same pitch diameter as the sun gear, whereby any point on the pitch circle of a planetary gear describes a cardioid as the planetary gear rotates around the sun gear once, the crankshaft eccentricity being substantially $\frac{1}{3}$ of the pitch radius of a planetary gear, said eccentric portion of each crankshaft having roller means rotatable about the same axis as the connection between the connecting rod and the eccentric portion, a ring member having an internal surface surrounding and contacting all of the roller means simultaneously, the ring member being free to rotate about its own axis, fuel metering means for providing a combustible mixture for the cylinders, ignition means to ignite the combustible mixture in each cylinder, three valves for admitting the combustible mixture to each cylinder, each valve having a valve shaft and a valve head at one end of the shaft, the shaft reciprocating in a bore of the rotary frame, the bore being substantially radially arranged with respect to the rotor axis, the shaft having at its end remote from the valve head a roller adapted to contact said internal surface of the ring member over a fraction of each rotor revolution, thereby to depress the valve for the admission of said combustible mixture, and porting means for exhausting products of combustion from each cylinder.

2. The combination claimed in claim 1, in which each crankshaft has connected to it two drum members each with an outer surface, the combination further including a further ring member concentric with the rotor axis and free to rotate, the further ring member having internal surfaces in contact with the outer surface of each drum member, whereby rotation of the rotor causes rotation at a faster speed of said further ring member, and whereby the further ring member functions to absorb at least part of the centrifugal load arising from the pistons and connecting rods.

3. The combination claimed in claim 2, in which the internal surfaces of both ring members are cylindrical.

4. The combination claimed in claim 3, in which the first-mentioned ring member has a T-shaped radial section, the stem of the T extending away from the axis of the sun gear.

5. The combination claimed in claim 4, in which the further ring member has a V-shaped radial section, the apex of the V extending away from the axis of the sun gear.

6. The engine claimed in claim 2, in which each piston lies between its respective crankshaft and the axis of the sun gear.

7. The combination claimed in claim 2, which further includes a stationary housing surrounding the rotor and said further ring member.

8. The combination claimed in claim 2, further including air cooling passages adjacent the portions of the rotor defining the cylinders, and means for forcing air through said passages.

9. The combination claimed in claim 2, which includes an additional freely rotating ring member having external retaining contact with portions of all the planetary gears, thereby to relieve the gear mounts of centrifugal loading.

* * * * *